US011700890B2

(12) United States Patent
Kaylin

(10) Patent No.: US 11,700,890 B2
(45) **Date of Patent: *Jul. 18, 2023**

(54) UPPER BODY SHAPER GARMENT

(71) Applicant: MINDD, Inc., West Hollywood, CA (US)

(72) Inventor: Helena Kaylin, Los Angeles, CA (US)

(73) Assignee: MINDD, Inc., West Hollywood, CA (US)

( * ) Notice: Subject to any disclaimer, the term of this patent is extended or adjusted under 35 U.S.C. 154(b) by 25 days.

This patent is subject to a terminal disclaimer.

(21) Appl. No.: 17/062,573

(22) Filed: Oct. 3, 2020

(65) Prior Publication Data

US 2021/0100293 A1 Apr. 8, 2021

Related U.S. Application Data

(60) Provisional application No. 62/911,192, filed on Oct. 4, 2019.

(51) Int. Cl.

| | |
|---|---|
| ***A41C 3/10*** | (2006.01) |
| ***A41C 3/14*** | (2006.01) |
| ***A41C 3/00*** | (2006.01) |

(52) U.S. Cl.

CPC ..... *A41C 3/10* (2013.01); *A41C 3/0021* (2013.01); *A41C 3/142* (2013.01)

(58) Field of Classification Search

CPC ..... A41C 3/10; A41C 3/0021; A41C 3/142
USPC ..... 450/74, 75
See application file for complete search history.

(56) References Cited

U.S. PATENT DOCUMENTS

| | | | |
|---|---|---|---|
| 1,446,928 | A | 2/1923 | Lyons |
| 4,413,626 | A | 11/1983 | Capasso |
| 5,605,060 | A | 2/1997 | Osborne |
| 6,790,122 | B2 | 9/2004 | Mitchell et al. |
| 7,546,751 | B2 | 6/2009 | Lutz |
| 9,883,702 | B2 | 2/2018 | Martinet et al. |
| 10,912,340 | B2 | 2/2021 | Diaz et al. |
| 2003/0082994 | A1 | 5/2003 | Mitchell et al. |
| 2004/0137822 | A1 | 7/2004 | Mitchell |

(Continued)

FOREIGN PATENT DOCUMENTS

AU 2013204662 A1 5/2014

OTHER PUBLICATIONS

Written Opinion for PCT/US2020/054184, dated Jan. 5, 2021.
International Search Report for PCT/US2020/054184, dated Jan. 5, 2021.

*Primary Examiner* — Timothy K Trieu
(74) *Attorney, Agent, or Firm* — DLA Piper LLP US

(57) ABSTRACT

Disclosed embodiments include an upper body shaper garment for women. The garment contours the breasts and other aspects of the chest area into a fashionable form by delivering distinct amount of compression force at select areas of the garment. In various embodiments, the shaper garment includes a support area covering the breasts and a shaping area including one or more compression zones for moving the support area to enhance the appearance of the wearer. The shaper garment may be knitted from one continuous piece of fabric with the compression areas knitted directly into the base layer. The shaper garment may also include one or more transition zones between the areas and/or zones of the garment to smoothly transition between different areas and/or zones.

17 Claims, 8 Drawing Sheets

(56) References Cited

U.S. PATENT DOCUMENTS

| | | | | |
|---|---|---|---|---|
| 2008/0011021 | A1* | 1/2008 | Starbuck | A43B 23/0205 66/170 |
| 2015/0017877 | A1 | 1/2015 | Cholet et al. | |
| 2017/0099884 | A1 | 4/2017 | Martinet et al. | |
| 2017/0119063 | A1 | 5/2017 | Diaz et al. | |
| 2017/0290376 | A1 | 10/2017 | Maheshwari et al. | |
| 2018/0199651 | A1 | 7/2018 | Blakely et al. | |
| 2018/0317569 | A1 | 11/2018 | Diaz et al. | |
| 2018/0317570 | A1* | 11/2018 | Diaz | D04B 1/246 |
| 2020/0109496 | A1 | 4/2020 | Lucas Gaus et al. | |
| 2021/0100293 | A1 | 4/2021 | Kaylin | |

* cited by examiner

UPPER BODY SHAPER GARMENT

CROSS REFERENCE TO RELATED APPLICATIONS

This application claims the benefit of U.S. Provisional Application Ser. No. 62/911,192 filed Oct. 4, 2019, the entire contents of which is hereby incorporated by reference.

FIELD

The present disclosure relates generally to under garments for women and, more specifically, to under garments for supporting, shaping, and enhancing upper body areas.

BACKGROUND

Shapewear is a class of clothing that seeks to modify one or more areas of the body of the wearer. Shapewear garments may temporarily alter the wearer's body shape to achieve a more fashionable figure. Shapewear may be worn as an undergarment beneath an outer layer of clothing or as a stand-alone garment.

Traditional upper body shapewear garments for women including bras, bralettes, corsets, and the like include wires, seams, glues, and other materials that are uncomfortable to wear. These garments also come in few sizes, therefore, poorly fit the body shape of most women. Support provided by the garments is inadequate and inflexible resulting in an uneven fit that leaves some areas unsupported and other areas too compressed and/or painfully tight or pinched. Current garments are also not designed for contouring and fail to improve the figure of the wearer.

SUMMARY

In one aspect, disclosed herein is an upper body shaper garment comprising: two cup portions with one cup for covering each breast of a wearer; a bottom band directly below the cup portions and extending across a chest area of a wearer beneath the breasts; and a back portion connecting to the cup portions and the bottom band via a set of wings, one wing on each side of the chest area of the wearer, the wings extending along the upper body shaper garment sides between a peripheral edge of each cup portion and the back portion, the upper body shaper garment knitted as one layer of continuous material without any seams, glues, or polymer adhesives, the cup portions comprising; a support area fitting tightly over each breast and capturing an upper middle portion of the breast, the support area controlling movement of an upper section of each cup portion; a shaping area directly below the support area and extending down from a lower peripheral edge of the support area to the bottom band, the shaping area including one or more compression zones knitted into each cup portion, the one or more compression zones compressing a bottom section of the cup portion to lift the support area above from the bottom band and push the support area out and away from the body of the wearer; and a first transition area at an intersection of the shaping area and the support area.

In one aspect, the upper body shaper garment comprises a triangular anchor knitted into the center of the upper body shaper garment between the cup portions and above the bottom band. In one aspect, the wherein the triangular anchor compresses a lower portion of the support area at an inside peripheral edge of each cup portion tightly against the body of the wearer, the triangular anchor pulling an inner side of each breast inside the support area and pushing the support area away from a midpoint of the chest area toward the wing of the upper body shaper garment, the triangular anchor lifting the inner side of each breast above and away from the bottom band.

In one aspect, the upper body shaper garment comprises the shaping area having three compression zones including a tightest compression zone, a high compression zone, and low compression zone. In one aspect, each compression zone has a unique stitch density defining a number of stitches per area of material within the compression zone;

In one aspect, the shaping area extends from a side peripheral edge of the cup portion against an upper flank of the wearer to a midpoint of the chest area below the breasts and above the bottom band. In one aspect, the shaping area is curved to follow a rounded portion along a bottom surface of each breast.

In one aspect, the wings include a medium compression zone extending from a bottom peripheral edge of the cup portion to a midpoint on the flank of the wearer midway between the bottom peripheral edge of the cup portion and the back portion. In one aspect, the medium compression zone pushes a side portion of each breast away from an upper flank of the wearer toward a midpoint of the chest area. In one aspect, the first transition area has a first stitch gradient that gradually increases a stitch density specifying a number of stitches kitted into an area of material from a first stitch density of the support area to a second stitch density of the shaping area.

In one aspect, the upper body shaper garment comprises a second transition area between the tightest compression zone and the high compression zone, a third transition area between the high compression zone and the low compression zone, and a fourth transition area between the low compression zone and the medium compression zone. In one aspect, the second transition area comprises a second stitch gradient that gradually decreases a stitch density specifying a number of stitches knitted into an area of material from a third stitch density of the tightest compression zone to a fourth stitch density of the high compression zone. In one aspect, the third transition area comprises a third stitch gradient that gradually decreases the stitch density from the fourth stitch density of the high compression zone to a fifth stitch density of the low compression zone. In one aspect, the fourth transition area compresses a fourth stitch gradient that gradually increases the stitch density from the fifth stitch density of the low compression zone to a sixth stitch density of the medium compression zone.

In one aspect, the shaping area generates a compression force lifting a lower portion of the support area away from the bottom band to contour the breasts into a fashionable form. In one aspect, the support area includes an auxetic material that becomes thicker as the support area is lifted by the compression force generated by the shaping area. In one aspect, the fashionable form is selected from the group comprising a round form that is equally full at the top and at the bottom; a teardrop form having the bottom slightly wider than the top; and a bell form having a full bottom and a narrower top.

In one aspect, the one layer of continuous material includes a three dimensional (3D) knit structure that replaces uncomfortable metal or plastic wires used in traditional manufacturing. In one aspect, the one layer of continuous material includes a 3D knit structure that provides comfort, support, and lift to each breast.

In one aspect, disclosed herein is a cup portion of an upper body shaper garment comprising; a support area fitting tightly over each breast and capturing an upper middle portion of the breast, the support area controlling movement of an upper section of the cup portion; a shaping area directly below the support area and extending down from a lower peripheral edge of the support area to the bottom band, the shaping area including one or more compression zones knitted into the cup portion, the one or more compression zones compressing a bottom section of the cup portion to lift the support area above from the bottom band and push the support area out and away from the body of the wearer; and a first transition area at an intersection of the shaping area and the support area.

BRIEF DESCRIPTION OF THE DRAWINGS

Various objectives, features, and advantages of the disclosed subject matter can be more fully appreciated with reference to the following detailed description of the disclosed subject matter when considered in connection with the following drawings, in which like reference numerals identify like elements.

DESCRIPTION

Figure 1:
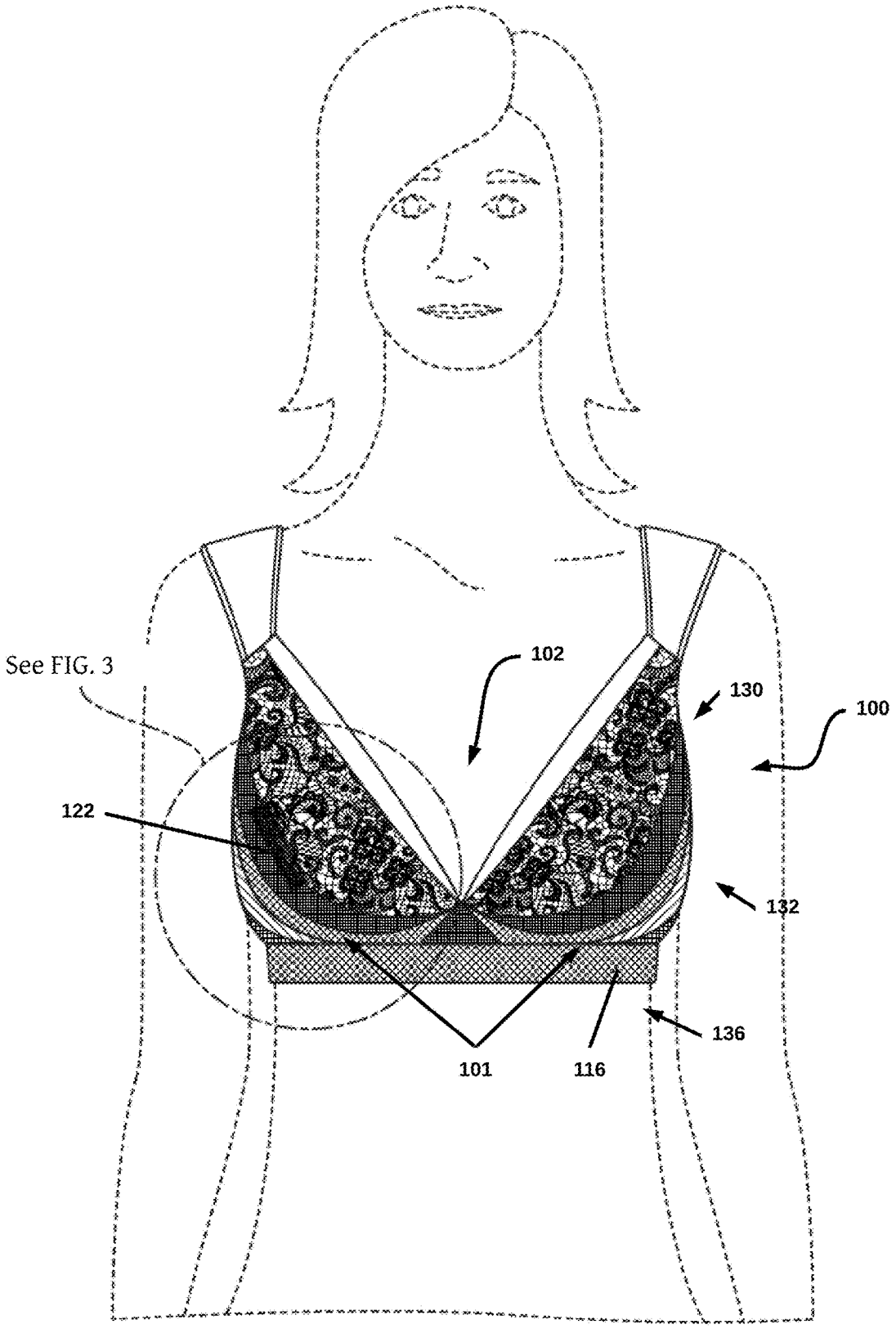
FIG. 1 depicts a front view of an exemplary shaper garment having a deep V neckline, according to embodiments of the disclosure.

The shaper garment described herein may shape the upper body of the wearer into a more slender and compact form to improve appearance. The upper body shaper garment may shape the breasts into a more rounded form and may increase the volume of the breasts using the wearer's own natural shape and body mass. In one embodiment, the upper body shaper garment may lift and/or contour the breasts into a more defined, fashionable form specific to the breast and/or body type of the wearer. The upper body shaper garment may lift and/or contour other aspects of the upper body including an under arm bulge and/or a below the shoulder bulge along with the breasts to form fuller and more round looking breasts. The lift and/or contour provided by the shaper garment may be customized according to the natural shape of the body of the wearer and an ideal contoured shape of the body of the wearer by modifying one or more areas of the shaper garment.

The shaper garment may be made of soft, breathable textiles that are comfortable to wear. In various embodiments, the shaper garment may be made from one continuous piece of material to exclude seams, glues, polymer adhesives, wires, and other uncomfortable features and/or materials. One or more compression zones and/or other areas of the garment that provide lift and contour functionality may be integrated into the upper body shaper garment to create a support system that conforms to the multidimensional female form. The compression zones may be stronger in some areas and more flexible in others to enhance the comfort, support, and contouring provided by the garment.

In various embodiments, the compression zones may be stitched into the shaper garment directly in one or more layers to avoid manufacturing processes that involve sewing multiple pieces of fabric together. The stitched areas may be flexible and breathable to enhance comfort in a variety of conditions. Compression zones and other shaping areas may be sewn into a variety of positions throughout the upper body shaper garment allowing the garment to fit a wide range of body types and breast shapes. Shaper garments may also a have one or more arrangements of compression zones that contour the breasts into a particular form (e.g., a bell form, round form, teardrop form, and the like).

Integrating the compression zones into a one piece knitted garment may improve the manufacturing process by eliminating glues, wires, and other non-textile materials. Additionally, knitting manufacturing processes used to form upper body shaper garment may be more efficient and create less waste than traditional manufacturing methods for bras and other garments. The upper body shaper garment may include a three dimensional (3D) knit structure that enhances the contouring performance of the garment and increases the durability of the compression zones. The 3D knit structure may also improve comfort of the garment relative to other bras. By acting as a second skin that grows and retracts to fit a particular body shape as it moves and changes, the 3D knit structure may give the garment more precise and flexible fit. The 3D knit structure may be responsive to cyclical changes in the shape of a women's body, in particular fluctuations in body mass and changes in the size and/or shape of the ribcage and/or breasts. By adapting to the shape of the wearer's body without sacrificing support, coverage, and/or comfort, the shaper garment may help resolve bra fit problems experienced by over 80% of women.

The compression zones and 3D knit structure may be incorporated into other garments including, for example, body suits, men's and women's underwear, shirts, pants, sorts, skirts, and the like. The compression zones and or 3D knit structure may be incorporated into particular areas of these garments to provide support for one or more particular body structures. The compression zones and or 3D knit structure may also be incorporated into particular areas of these garments to contour a particular portion of the body of the wearer into an ideal body shape.

Figure 8:
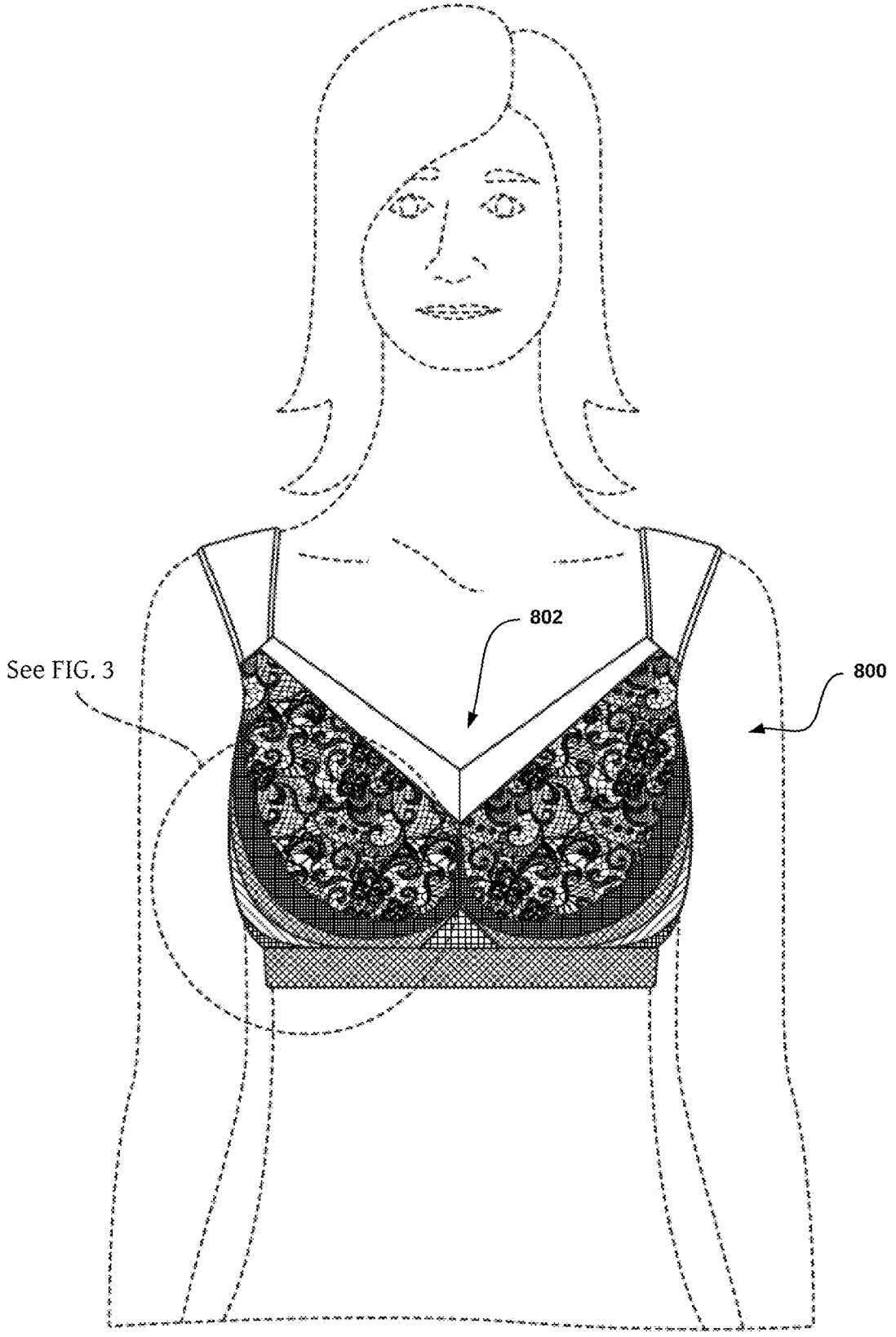
FIG. 8 illustrates a front view of an exemplary shaper garment having a flat V neckline, according to embodiments of the disclosure.

FIG. 1 illustrates an exemplary embodiment of an upper body shaper garment 100. The upper body shaper garment 100 include any shape or configuration of garment that covers the chest area of the wearer. For example, the upper body shaper garment 100 may have a deep V shape and include shoulder straps as shown in FIG. 1. As shown in FIG. 8, the upper body shaper garment 100 may also have flatter neckline and shoulder straps. The upper body shaper garment 100 may also have a completely flat neckline that extends horizontally across the chest of the wearer and or may include no shoulder straps. Strapless versions of the upper body shaper garment 100 may be held in-place on the body of the wearer by the compression provided by the compression zones or other areas of the strapless version of the upper body shaper garment 100.

Figure 2:
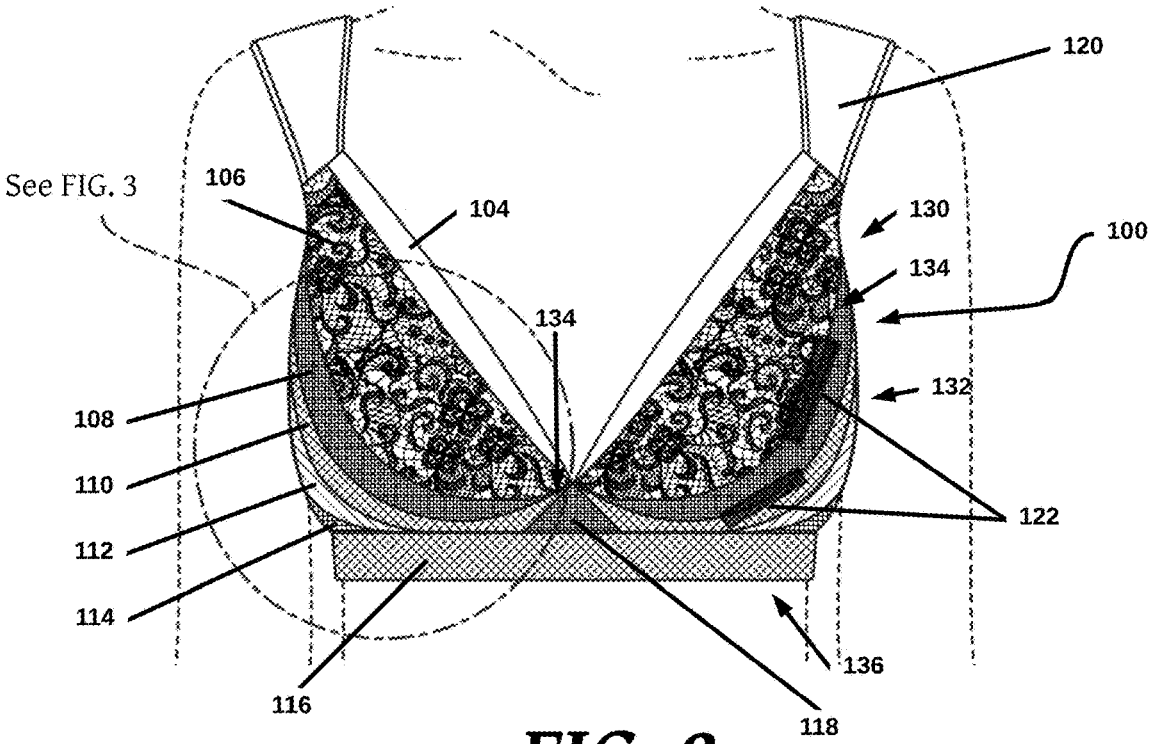
FIG. 2 illustrates a close up front view of the exemplary shaper garment of FIG. 1, according to embodiments of the disclosure.
Figure 3:
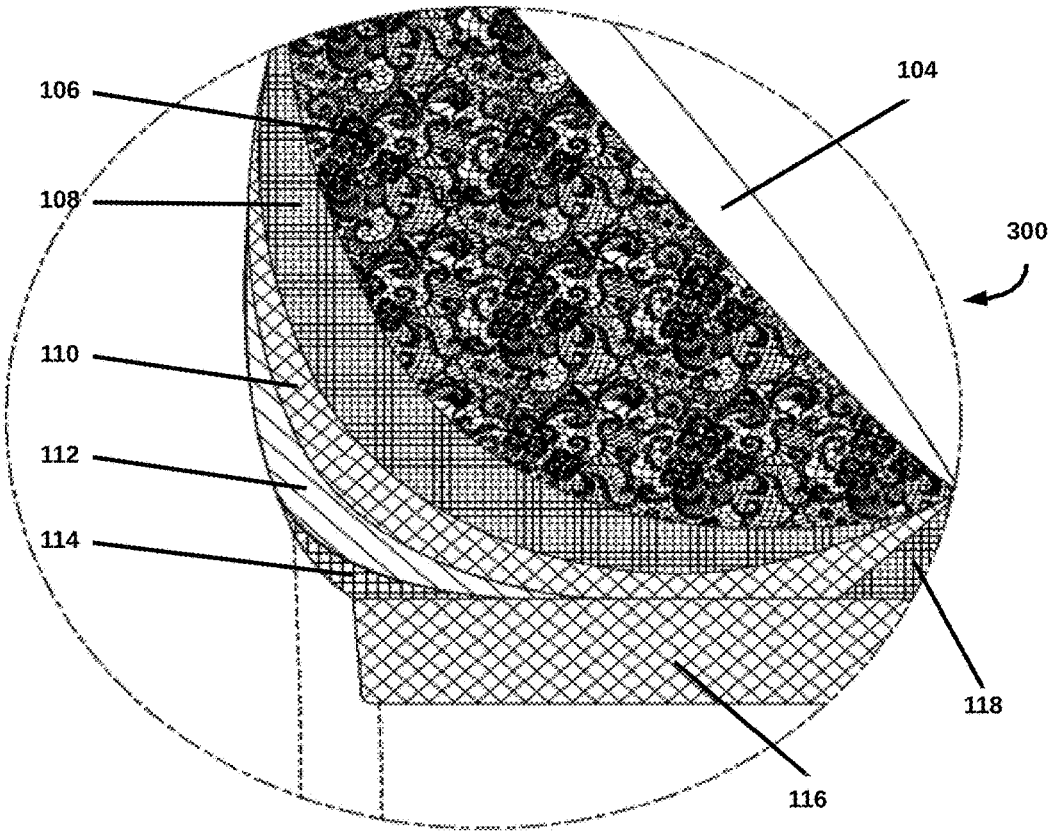
FIG. 3 illustrates a close up front view of a cup portion included in an exemplary shaper garment, according to embodiments of the disclosure.

As shown in FIG. 1, the upper body shaper garment 100 may be worn above the stomach and may wrap around the mid flanks and upper back of the wearer. The upper body shaper garment 100 may include a back portion that connects to the cup portions 101 and/or the bottom band via a set of wings. The back portion may have any style and or configuration, for example, a flat back, cross back, back closure, and the like. The back closure versions of the upper body shaper garment 100 may include a clip for securing two halves of the upper body shaper garment together at the back of the garment. In various embodiments, the upper body shaper garment 100 may include two wings one on each side of the upper flank of the wearer. The wings may extend along the sides of the upper body shaper garment 100 between a side peripheral edge of the cup portion and the back proton. The wings are shown in more detail below in FIGS. 4A-6. The upper body shaper garment 100 may include a variety of styles and cuts. Different styles may have different necklines, different back designs, different strap designs, strapless designs, and the like. For example, a deep V neckline 102 as shown in FIG. 1. FIGS. 2-3 below illustrate more details of the upper body shaper garment shown in FIG. 1, with FIG. 3 illustrating a close up view of a cup portion for the garment.

As shown in FIG. 1, the upper body shaper garment 100 may be worn over the chest area of the wearer's body and may include two cup portions 101 covering the breasts of the wearer. Each cup portion 101 may cover one breast of the wearer and the cup portions 101 may be directly above a bottom band 116 that extends across a chest area of the wearer. The cup portions 101 may include a support area 130 and a shaping area 132 directly below the support area 130. The shaping area 132 may be integrated into the support area 130 using a knitting process that creates a 3D knit structure throughout the shaping area 132 and/or support area 130. The 3D knit structure may adapt to the wearer's unique body shape to enable a more precise fit that responds to changes in the size and shape of specific areas of the wearer's body. The upper body shaper garment 100 may fit tightly against the body of the wearer with the support area 130 fitting tightly over each breast to capture an upper middle portion of the breast. The support area 130 may control movement of the upper section of the cup portions 101 to prevent the breasts from moving when captured within the support area.

Figure 10A:
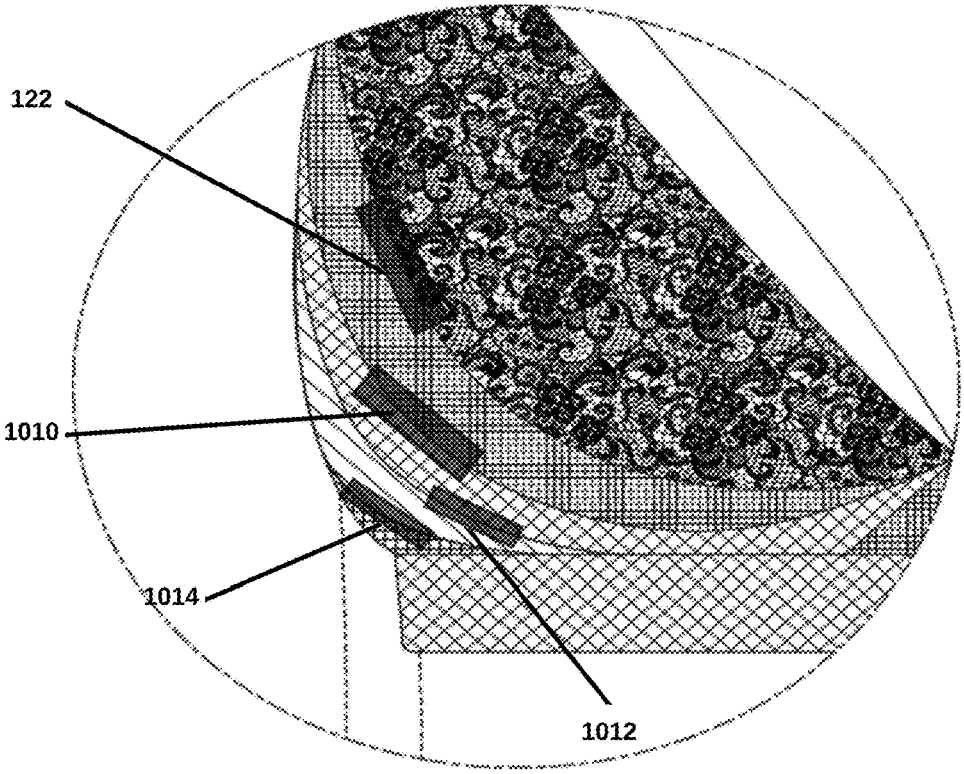
FIGS. 10A-10B illustrate an exemplary three dimensional (3D) knit structure having a stitch gradient, according to embodiments of the disclosure.
Figure 10B:
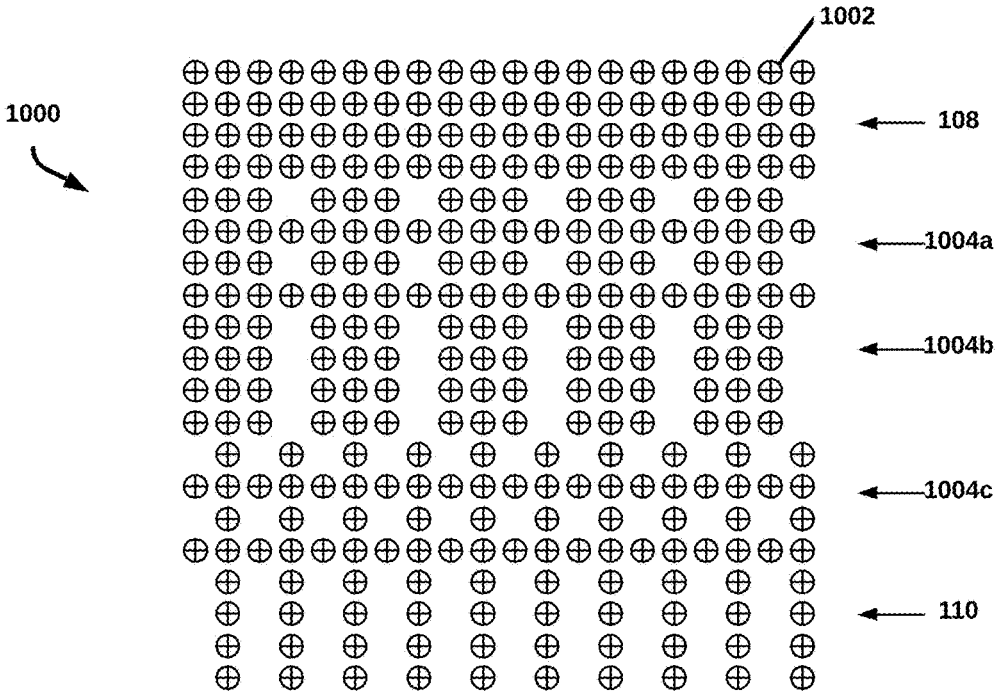

The shaping area 132 may be directly below the support area 130 and may extend down from a base section of each cup portion 101 along the lower peripheral edge of the support area 130 to the bottom band 130. The shaping area 132 may extend from a side peripheral edge of the cup portion against an upper flank 136 of the wearer to a midpoint of the chest area below the breasts and above the bottom band 116. The shaping area 132 may be curved to follow a rounded portion at the base and/or side of the breasts. The shaping area 132 may include one or more compression zones compressing the base of the cup portions to lift the support area 130 above and away from the bottom band 116. One or more transition areas 122 may be between the shaping area 132 and the support area 130 and or at the intersection between two or more compression zones. The one or more transition areas 122 may have a stitch gradient that gradually decreases and/or increases the stitch density specifying a number of stitches knitted into an area of material between two or more areas and/or zones of the upper body shaper garment 100. FIGS. 10A-B below illustrate transition areas and stitch gradients included in a 3D knit structure of the exemplary upper body shaper garment 100 of FIG. 1 in more detail.

FIG. 2 illustrates a close up front view of the exemplary upper body shaper garment 100 shown in FIG. 1. The shaper garment 100 may include one or more straps 120 worn over the shoulder of the wearer that help secure the garment to the wearer's body and provide an anchor point for lift that may be provided by the shaper garment 100 to the chest area of the wearer. A bottom band 116 may be included in the bottom portion of the shaper garment 100 directly below the cups. The bottom band 116 may lay flat against the body of the wearer and may help compress the cup portions over the breasts of the wearer to support, lift, and shape the chest area of the wearer.

In various embodiments, the shaper garment 100 may include a support area 130 and a shaping area 132. The shaping area 132 may include one or more compression zones that may provide the shaping functionality of the shaper garment 100. To enhance the comfort of the shaper garment 100, the one or more compression zones may be integrated into the shaper garment as one piece of material without seams. The shaper garment 100 may be manufactured using a seamless knitting process that selectively increases the stitch density within the one piece shaper garment 100 to create the one or more compression zones. The seamless knitting process may be a continuous knitting process that incorporates a variety to stitches to generate garments having distinct areas with different properties in a continuous manufacturing process. Using the seamless knitting process, garments with areas having different diameters, patterns, weights and other properties may be generated without cutting sections from multiple fabrics and/or sewing seams to connect the different cut sections.

The seamless knitting process may create a 3D knit structure within the upper body shaper garment that enhances the comfort and performance of the garment. In various embodiments, the compression zones may be knitted into the garment in specific places to deliver more compression, support, and lift in some areas and less compression, support, and lift in other areas. Transition areas 122 within the 3D knit structure may be positioned between one or more compression zones. The transition areas 122 may include a stitch gradient that allows the compression delivered by each compression zone to gradually transition from a first compression zone to a second compression zone. FIG. 10B below shows an exemplary 3D knit structure having a transition area including a stitch gradient that gradually transitions between the stitch density in the tightest compression zone to the stitch density of in the high compression zone.

The shaper garment may be assembled using a variety of compression materials including natural fabrics, synthetic fabrics, or some combination. Shaper garments assembled using the seamless knitting process may be manufactured by knitting yarn at various knit weights. For example, the yarn may be a composite yarn including Nylon and LYCRA®. The yarn may have a Nylon composition that ranges from 40% to 90% Nylon and a LYCRA® composition that ranges from 10% to 40% LYCRA®. In one embodiment the yarn may be 76% Nylon and 24% LYCRA®. Various types of Nylon and LYCRA® materials may be used, for example, Nylon 6.6 and Elastanie LYCRA®.

The material of the shaper garment and/or the network of stitches included in the 3D knit structure of the one or more compression zones may be auxetic, thus the material of the 3D knit structure may become thicker as it is stretched (i.e., the material becomes thicker the more it gets stretched). Shaper garments including auxetic material may provide more support and/or lift to the garment the more the garment is stretched. Auxetic shaper garments may also provide a stronger shaping force the more the garment is stretched. Therefore, auxetic shaper garment embodiments may provide a customized level of support, lift, and/or shaping that varies according to the unique body shape of the wearer and is responsive to changes in one or more areas of the wearer's body. For example, portions of the wearer's chest area that extend farther away from the center of the wearer's body will stretch the shaper garment more. Accordingly, the garment will deliver more support, lift, and/or shaping to the extended areas of the body of the wearer relative to the areas of the body that are closer distance from the center of the body. The variable amount of support, lift, and/or shaping provided by the shaper garment material may allow the garment to move areas of the wearer's body that extend farther from a desired location more than areas of the wearer's body that are closer to their desired position. The customized level of support, lift, and/or shaping provided by the shaper garment ensures a more comfortable fit for a greater variety of body shapes and sizes. The customized level of support, lift, and/or shaping may enhance the shaping functionality of the shaper garment by selectively moving different areas of the wearer's body different amounts to produce a more fashionable figure that has a natural shape and does not have any uneven and/or artificial looking lumps, depressions, gaps, uneven areas, and the like.

FIG. 2 illustrates an exemplary shaper garment having multiple compression zones on the underside of the support area 130 of each cup portion. Embodiments of the shaper garment may have one or more compression zones to provide shaping functionality and ensure a comfortable fit and ample breast support. The one or more compression zones may different compression strengths to provide the optimal amount of support, lift, and/or shaping in each unique portion of the wearer's chest area. In various embodiments, compression layers included in shaper garment may be customized according to a particular wearer's body shape.

Shaper garments may be manufactured according to specifications that are specific to a wearer's body shaper. To manufacture a personalized shaper garment, dimensions of wearer's body may be determined during a fitting process where the wearer's chest area is measured. The wearer's preferred body shape may then be discovered by generating one or more optimal figure shapes using the wearer's the chest measurements. The one or more optimal figure shapes may include dimensioned outlines and/or silhouettes of exemplary fashionable figures having similar chest measurements. Based on the optimal figure shape selected by the wearer, the shaper garment 100 is then manufactured with a specific type and/or location of the one or more compression zones to provide the modifications needed to adjust the wearer's particular body shape to match a selected optimal figure shape.

The exemplary shaper garment 100 shown in FIG. 2 includes a support area 130 and a shaping area 132 including three compression zones. As shown in the FIG. 2, the support area 130 may include a breathable mesh material 104 that may comprise the area of the cup portion covering the breast. The breathable mesh material 104 may act as a net that holds and/or positions the breasts comfortably within the cup portions to allow the breasts to be supported naturally and in place. The support area 130 encapsulates the breasts in their natural position allowing the breasts to be lifted and/or contoured with comfort. In various embodiments, the breathable material may be knitted in a fashionable pattern 106, for example, a lace pattern, to give the garment a more beautiful aesthetic. In various embodiments, the breathable mesh material 104 of the support area 130 may be manufactured using the seamless knit process described above. The seamless construction gives the breathable material 104 more stretch and elasticity than lace or other traditional patterned materials, thereby enhancing the performance and comfort of the garment. In various embodiments, the breathable mesh material 104 may be a single layer material and/or a double layer material. The double layer configuration of the breathable mesh material 104 may have an outer layer including a fashionable pattern 106 formed over an un-patterned inner layer. In various embodiments, the breathable mesh material 104 may be replaced with a traditional lace material and/or other fancy lace or jacquard designs.

The shaping area 132 may be positioned directly under the support area 130 at the base of the cup portion directly under the breast. The shaping area 132 may generate a compression force lifting a lower portion of the support area 130 away from the bottom band 116 to contour the breasts into a fashionable form and or ideal breast shape or ideal body shape. One or more compression zones included in the shaping area may generate the compression force that may be used to contour the breasts. In various embodiments, the compression zones may contour the breasts by, for example, pushing the breasts into the support area, lifting the support area vertically above the bottom band, pulling the support area out away from the body of the wearer, and/or otherwise changing the position of the support area.

The compression zones may be formed using seamless knit process that incorporates a variety of stitch types and stitch densities to produce compression zones having different weights. The 3D knit structure of the compression zones may lift, shape, and/or contour the breasts in the most comfortable and natural way that eliminates tight and uncomfortable areas of traditional bras and under garments that can leave makes on the wearer's body, for example, the wire region under the cup of traditional bras. The seamless construction of the compression zones eliminates sewn seams that can chaff and irritate the area of the wearer's skin in contact with the seams. The compression zones may be manufactured from breathable materials, for example, yarn including Nylon and LYCRA®. The breathable construction provides air flow to the breast region and may allow the compression zones to wick sweat and other moisture away from the underband of the breasts and the cleavage area between the breasts.

As illustrated in FIG. 2, the shaping area 132 may have three compression zones including a tightest compression zone 108, a high compression zone 110, and a low compression zone 112. The compression zones may be knitted directly into the shaper garment by knitting stitches into the continuous single layer of comprising the shaper garment to form a region of the garment having a distinct stitch density. Other configurations of the shaping area and or arrangements of compression zones may also be provided. For example, garments may have a greater or smaller number of compression zones and the order of the compression zones may be changed (i.e., the low compression zone 112 may be placed above the high compression zone 110, a second tightest compression zone 108 may be added below the low compression zone 112, and the like). Embodiments of the shaper garment may be used during sports or other activities including different performance requirements. To meet these requirements, the shaper garment may include a sport support area that may have a different arrangement of compression zones.

The sport support area may have an arrangement of compression zones that creates a damping effect to soften the impact of breasts of the wearer during activities that include intense motion (i.e., jumping or running). The compression zones may absorb some of the kinetic energy and or vibrations of the breasts during periods of intense motion to reduce the amplitude of oscillation of the breasts (i.e., the amount of side to side and or vertical motion of the breasts) and soften the impact of the breasts against the shaper garment. To generate the dampening effect one or more compression zones, other aspects of the shaping area (i.e. the wings or other side supports), and or other aspects of the shaper garment (i.e., the straps) may include a damping spring system that enhances the comfort of the shaper garment by eliminating trauma to the breast tissue that may occur during activities including intense motion. To eliminate the trauma to the breast tissue, the damping effect provided by the damping spring system may reducing the amount of side to side and vertical motion of the breasts. The spring system may also allow the breasts to have a soft landing into the cup portions of the shaper garment and may absorb some of the vibrations that can occur during intense motion.

The sport support area may integrate the damping spring system into the compression zones and or 3D knit structure to ensure embodiments having the sport support area have a flexible fit that acts as a second layer of skin and conforms to any body shape. Unlike traditional sportsbras that simply restrict movement by compressing the breasts, embodiments of the shaper garment that include the sport support area control motion to increase comfort. The combination of the compression zones, 3D knit structure and damping spring system provides a breaking effect that absorbs energy and vibration that can occur during motion to control the movement of the breasts and allow each breast to be individually encapsulated and supported. The fit and dampening provided by the embodiments of the shaper garment included in the sport support area, ensures the wearer is able to breath naturally and does not feel restricted or confined.

In various embodiments, the stitch density of the compression zone or other garment region is directly proportional to the strength of the compression force provided by compression zone or other garment region. The strength of the compression force may be described by the knit weight of the compression zone. In knitted materials, knit weight is controlled by loop length. Fabrics having smaller knitted loop lengths are more compact, therefore have a higher stitch density and a greater weight per area of material. Conversely, fabrics having larger knitted loop lengths are less compact, therefore have a lower stitch density and a lower weight per area of material. In various embodiments, compression zones having a larger knit weight may have a greater compression force and stitch density. Conversely, compression zones having a smaller knit weight may have a lighter compression force and a smaller stitch density. The knit weight of compression zones included in the shaper garment may be within the range of 100 grams per square meter (gsm) to 500 gsm. In various embodiments, the knit weight of the compression zones may be between 270 gsm and 365 gsm.

In various embodiments, the tightest compression zone 108 may be located at the top of the shaping area 132 and may intersect the lower peripheral edge 134 of the support area 130. The tightest compression zone 108 may deliver a first layer of support, lift, and/or shaping to the underside of the breast. In various embodiments, the tightest compression zone 108 may include a triangular anchor 118 at the center of the chest area between the two cup portions and above the bottom band 116. The triangular anchor 118 may be made of the same tightest compression material as the tightest compression zone 108 and may be integrated into the tightest compression zone 108 or stitched separately into the portion of the shaper garment between the two cup portions. The triangular anchor 118 may provide a central anchor for the cup portions that may augment the lift, support, and/or contouring functionality provided by the cup portions. The triangular anchor 118 may also help separate the right and left breasts into their respective right and left cup portions. In various embodiments, the triangular anchor 118 may intersect the inside peripheral edge 134 of each cup portion at the center of the chest area. The triangular anchor 118 may compress a lower portion of the support area 130 tightly against the body of the wearer to pull an inner side of each breast inside the support area and/or push the support area away from a midpoint of the chest area toward the side peripheral edge of the cup portion. A compression force generated by the triangular anchor 118 may lift the inner side of each breast vertically above the bottom band and/or push the inner side of each breast out away from the body of the wearer.

To avoid seams produced when two different types of fabric are combined, the tightest compression zone may be knitted into the one piece shaper garment 100 by increasing the stitch density in the area of the shaper garment 100 where the tightest compression zone 108 is located. To increase the stitch density, additional stitches may be knitted into the material. During the knitting process, stitches may be tightly packed within the tightest compression zone 108. In various embodiments, the one or more compression zones may have stitches sewn into every area included in the compression zone so that there is no open space between stitches. One or more compression zones may also have multiple stitches sewn into the same location with the one or more stitches sewn over and on top of the base stitch or stitches. In various embodiments, the one or more compression zones may include a three dimensional (3D) network of stitches they extends out from the surface of the shaper garment material. The network of stitches may be arranged to from an auxetic material that may provide more support, lift, and or shaping, the more the garment is stretched.

As shown in FIG. 2, the shaper garment 100 may include a high compression zone 110 positioned below the tightest compression zone 108. The high compression zone 110 can have a lower stitch density compared to the tightest compression zone 108. In various embodiments, the high compression zone 110 may augment the support, lift, and/or shaping performed by the tightest compression zone 108 by providing an additional high compression layer that may contour and/or shape chest areas lifted by the high compression zone 110. For example, the tightest compression zone 108 may provide a primary lift function and the high compression zone 110 may provide a primary shaping function and a secondary lift function. The tightest compression zone 108 and the high compression zone 110 may work together to lift and shape the breast with most of the upward movement to the breast provided by the tightest compression zone 108 and most of the breast shaping (e.g., rounding, curving, contouring, and the like) and extending out from the body of the wearer provided by the high compression zone 110.

The stitch density and position of the high compression zone 110 may allow the shaper garment 100 to lift and shape the breast into a natural, fashionable form and or ideal breast shape that may enhance the appearance of the chest area. The tightest compression zone 108 and the high compression zone 110 may shape the breast into a fashionable form and or ideal breast shape by elevating and supporting the underside of the breast to increase the lateral surface area of the breast and contour the breast into a fuller and rounder form. In various embodiments, the tightest compression zone 108 and the high compression zone 110 may contour the breast into one or more ideal breast shapes including: a round form that is equally full at the top and at the bottom; a teardrop form having the bottom slightly wider than the top; and/or a bell form having a full bottom and a narrower top. Shaper garments may contour the beast into a round shape, teardrop shape, and/or bell shape and reduce flattening of the breasts by positioning the tightest compression zone 108 and the high compression zone 110 under the breast. Arranging the high compression zone 110 below the tightest compression zone 108 may cause the high compression zone 110 to surround the base of the breast area lifted by the tightest compression zone 108. Selectively compressing the base of the elevated breast area while leaving the side and top portions of the breast uncompressed may allow the high compression zone 110 to shape the breast into a fuller and rounder form without flattening the breasts.

The location, size, and type of compression zones included in the shaper garment 100 may be varied to produce a particular shaping function. For example, the edges of the high compression zone 110 may be wider than the middle portion of the high compression zone 110 to deliver additional compression at the side portions of the base of the breast to produce a teardrop form. The width of the tightest compression zone 108 may also be wider than the width of the high compression zone 110 to provide more lift and less shaping. Additional compression zones having a compression strength between the tightest compression zone 108 and the high compression zone 110 may also be incorporated into the upper body shaper garment.

In various embodiments, the high compression zone 110 may include a bottom band 116 positioned below the cup portions and the triangular portion 118. The bottom band may be made of the same high compression material as the high compression zone 116 and may be integrated into the high compression zone and/or separately knitted into the shaper garment. The bottom band 116 may fit tightly against the upper chest of the wearer just below the breasts. By fitting tightly against the body of the wearer, the bottom band 116 ensures a tight fit of the cup portions over the breasts to eliminate slack in the cup portions and ensure a good fit. The bottom band 116 may also act as a lower boundary for the chest area covered by the shaper garment 100 to help control the direction of the contouring provided by the compression zones.

As shown in FIG. 2, the shaper garment 100 may include a low compression zone 112 positioned below the high compression zone 110. In various embodiments, the low compression zone 112 may include a ribbed detail or line pattern having stitched lines of medium and/or high compression material knitted into a low compression base. The low compression zone 112 may augment the tightest compression zone 108 and the high compression zone 110 by delivering additional lift and/or contouring to the breasts and chest area. The low compression zone 112 may enhance the comfort of the shaper garment by providing more flexible areas of the shaper garment 100 over portions of the chest area that do not require as much lift and/or contouring.

The compression strength of the compression zones may gradually decrease within the shaping area 132 of the cup portion. In various embodiments, the compression strength of the compression zones gradually decreases in areas of the shaping area 132 that extend further away from the breast. For example, the cup portion may include a tightest compression zone 108 directly under the breast, a high compression zone 110 below the tightest compression zone 108, and a low compression zone 112 below the high compression zone 108. The gradual shift in compression strength of the compression zones may enhance the comfort of the shaper garment by more evenly distributing the compression force of the compression zones across a wider surface area to minimize the areas of the shaper garment that dig-in, pitch, or otherwise fit uncomfortably in the chest area. The gradual variation in compression strength may also smooth out shapes and/or lines created when the compression zones contour portions of the chest area into one or more fashionable forms and or ideal shapes. By eliminating sudden changes in the amount of compression provided by the compression zones, the shaper garment 100 contours the chest area of the wearer into a naturally looking form that does not appear artificial or transient.

Figure 4A:
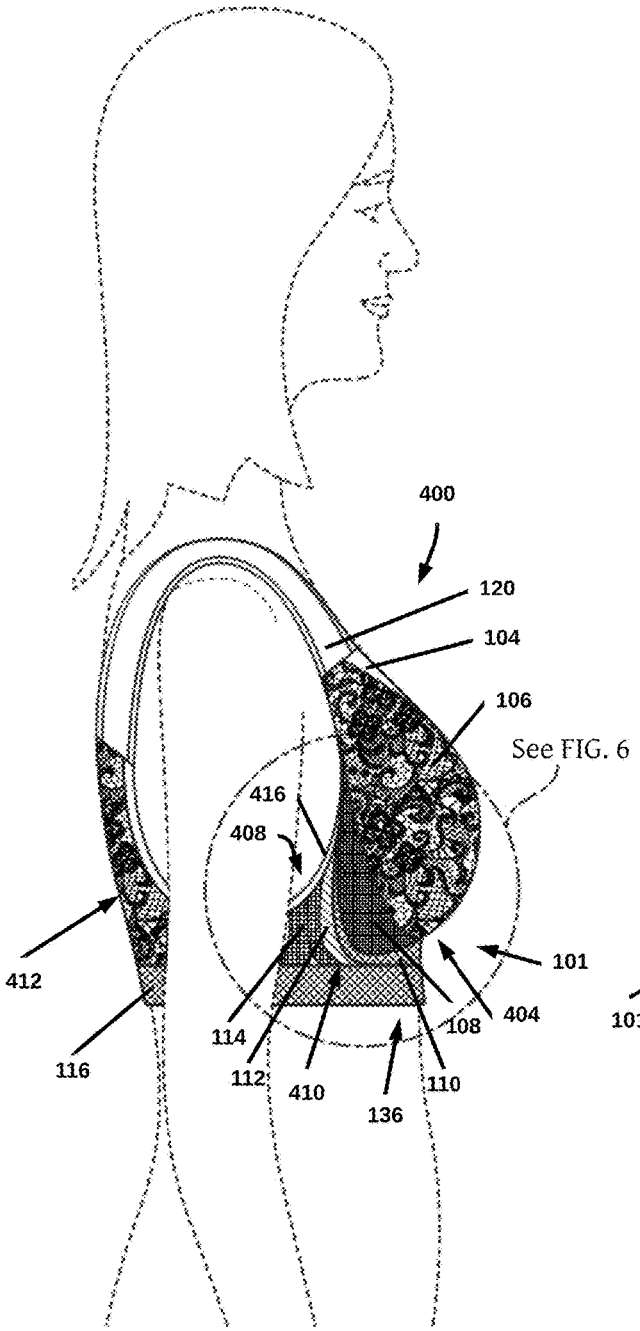
FIGS. 4A-4B illustrate right and left side views of an exemplary shaper garment, according to embodiments of the disclosure.
Figure 4B:
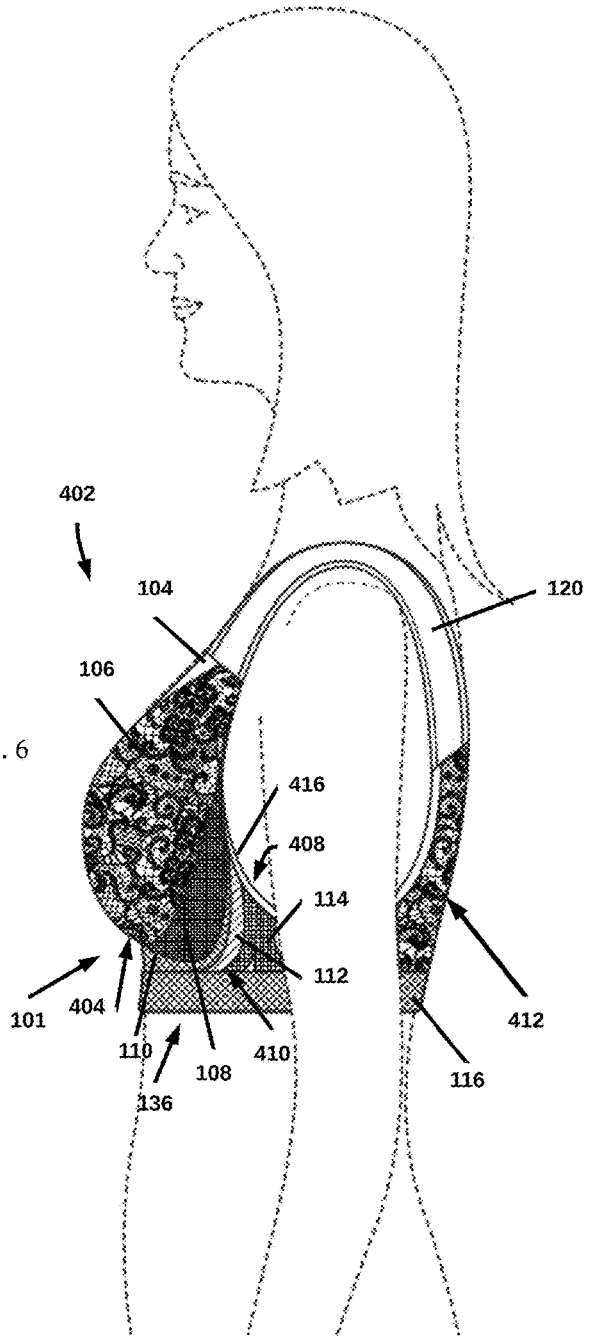

The shaper garment illustrated in FIG. 2 can include a medium compression zone 114 on the side of the cup portion of the shaper garment 100. The medium compression zone 114 may be included in one or more wings extending from the side of the shaper garment and connecting the cup portions with the back. The medium compression zone 114 may augment the support, lift, and/or contouring provided by the compression zones included in the shaping area 132 by supporting, lifting, and/or contouring the side portions of the chest area and upper flank 136 of the wearer. The medium compression zone 114 may also support, lift, and/or contour portions of the chest area including the breasts that have been compressed by the cup portions in a way that causes the portions to extend away from the center of the chest. For example, the of medium compression zone 114 may contour portions of the chest area compressed in one direction by the cup portion (e.g., lifted from below the breasts) into an ideal body shape by providing lift and/or additional compression from a second direction (e.g., lifted and/or compressed toward the center from the side of the breasts). The medium compression zone 114 may augment the contouring performed by other compression zones included in the shaping area 132 by pushing side portions of the breasts away from the upper flank 136 of the wearer toward a midpoint of the chest area. FIGS. 4A-4B illustrate a side perspective of an exemplary shaper garment including the medium compression zone 114.

The shaper garment may include one or more transition areas 122 between the compression zones. By gradually adjusting the stitch density of one compression zone to the stitch density of a second compression zone at the boundary between compression zones, the transition areas 122 enhance the comfort of the shaper garment by minimizing the portions of the garment susceptible to digging-in, pitching, or otherwise fitting uncomfortably against the body of the wearer. A gradient of stitch density included in the transition layers may also smooth lines created by the contouring compression zones. FIG. 10B below illustrates an exemplary stitch gradient that may be included in the transition areas 122.

FIG. 3 illustrates a closeup view of a left cup portion 300 of an exemplary shaper garment. The left cup portion 300 includes a breathable mesh material 104 including an outer layer having artistic lace pattern 106. The left cup portion 300 may can include one or more compression zones that support, lift, and/or contour portions of the chest area. The exemplary shaper garment shown in FIG. 3 includes four compression zones with three compression zones included in the cup portion and one compression zone located to the side of the cup portion. The three compression zones included in the cup portion may include a tightest compression zone 108 directly under the breathable mesh material 104, a high compression zone 110, below the tightest compression zone 108, and a low compression zone 112 at the base of the cup portion below the high compression zone 110. The triangular portion 118 and bottom band 116 are also visible in the illustration of the left cup portion 300 shown in FIG. 3.

FIGS. 4A-4B illustrate side views of an exemplary shaper garment. FIG. 4A illustrates a right side 400 view and FIG. 4B illustrates a left side 402 view. As shown in the FIGS. 4A-4B, the exemplary shaper garment may have two cup portions 101 each including a breathable mesh material 104 having an outer layer with an artistic lace pattern 106 and three compression zones 108, 110, and 112 to lift, support, contour, and compress the breasts especially the lower portion on the underside of the breasts 404. In various embodiments, the shaper garment can include a bottom band 116 that extends around the circumference of the upper chest of the wearer's body just below the breasts. The shaper garment may include a fourth compression zone, for example, a medium compression zone 114 at the side of the cup portions 101. The medium compression zone 114 may extend into a wing 408 that runs from the base of the cup portion 410 to the middle of the upper flank 136.

In various embodiments, the wing 408 can be integrated into the upper body shaper garment using the seamless knitting process described above. The seamless wing construction may enhance the comfort of the shaper garment and the lifting, shaping, and/or contouring functionality of the medium compression zone 114. In various embodiments, the wing 408 may extend the full width of the upper flank 136 from the base of the cup portion 410 to the back 412 of the wearer. The wing 408 may include a medium compression zone extending from a bottom peripheral edge 416 of the cup portion at the base of the shaping area to an upper flank 136 of the wearer midway between the cup portion and the back of the shaper garment.

The medium compression zone 114 included in the wing that can lift, support, and/or contour the upper flank 136 and/or areas of the breast 404 that are not fully contained within the cup portion 101. For example, the wing 408 can support the side of the wearer's body under the arm to support the side of the breast and contour the breast into an ideal breast shape and or an ideal body shape. In various embodiments, the wing 408 may contour a side portion of the breast 404 that extends out from the cup portion 101 as a result of compression applied by one or more compression zones included in the cup portion 101. Contouring provided by the medium compression zone 114 of the wing 408 may move the side portion of the breast that extends out of the cup portion 101 back towards the center of the wearer's chest and away from the upper flank 136. In various embodiments, medium compression zone 114 of the wing 408 can contour a side portion of the breast by curving the side portion into a rounded shape that extends out from the upper flank 136. By lifting the side portions away from the upper flank 136, the medium compression zone 114 of the wing 408 can increase the surface area of the chest that extends out from the upper flank 136 and chest area to contour the breasts into a larger and more dramatic curved shape.

The seamless construction and the 3D knit structure of the medium compression zone 114 included in the wing 408 may enhance the fit of the garment around the upper flank 136, back, and under arm regions of the wearer's body. The flexibility and responsiveness of the 3D knit structure allow the wing 408 to fit more naturally and comfortable around the wearer's body. The seamless construction of the wing 408 and 3D knit structure of the medium compression zone 114 may also distribute and/or reduce the pressure of the compression force against the side of the breasts and the back, under arm, and or upper flank portions of the wearer's body. By eliminating the sewn seam pressure points, the wing 408 may reduce the overflow of body mass (i.e., body tissue of the wearer) out of the shaper garment to minimize the appearance of excess body mass and create a smooth line between the wearer's body and the bra itself. For example, the wing 408 may reduce the overflow of body mass out from side and back portions of the garment to minimize the amount of excess body mass appearing around the intersection between the garment and the arms and back of the wearer's body. By reducing the amount of excess body mass overflowing from the shaper garment, the shaper garment may increase the volume of the breasts and create a smooth line and/or seamless infinity edge between the garment and the wearer's body.

Figure 5:
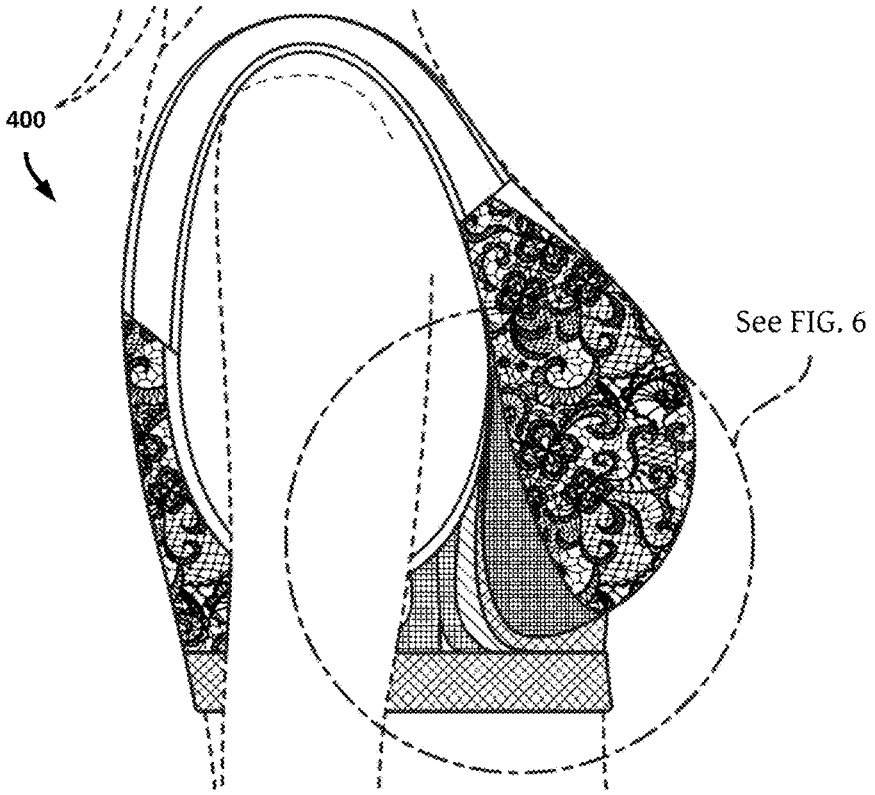
FIG. 5 illustrates a closeup view of one side of an exemplary shaper garment, according to embodiments of the disclosure.
Figure 6:
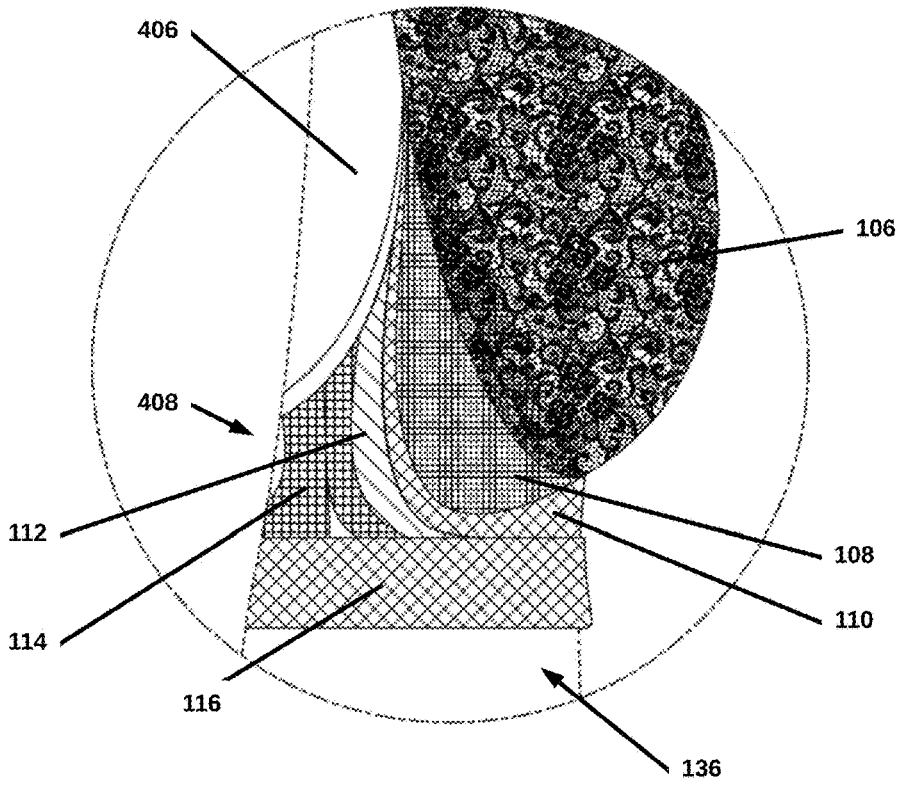
FIG. 6 illustrates a closeup view of one side of a cup portion included in an exemplary shaper garment, according to embodiments of the disclosure.

FIGS. 5-6 illustrate a close up view of the ride side of the shaper garment. FIG. 5 illustrates a close up view of the entire right side 400 of the garment and FIG. 6 illustrates a close up view of the ride side of the cup portion. As shown in FIG. 6, the cup portion includes a breathable mesh material having an outer layer with an artistic lace pattern 106 and three compression zones 108, 110, and 112. The exemplary shaper garment may also include a wing 408 extending out from the side of the cup portion toward upper flank 136 of the wearer and a bottom band 116 worn tight against the wearer's body.

Figure 7:
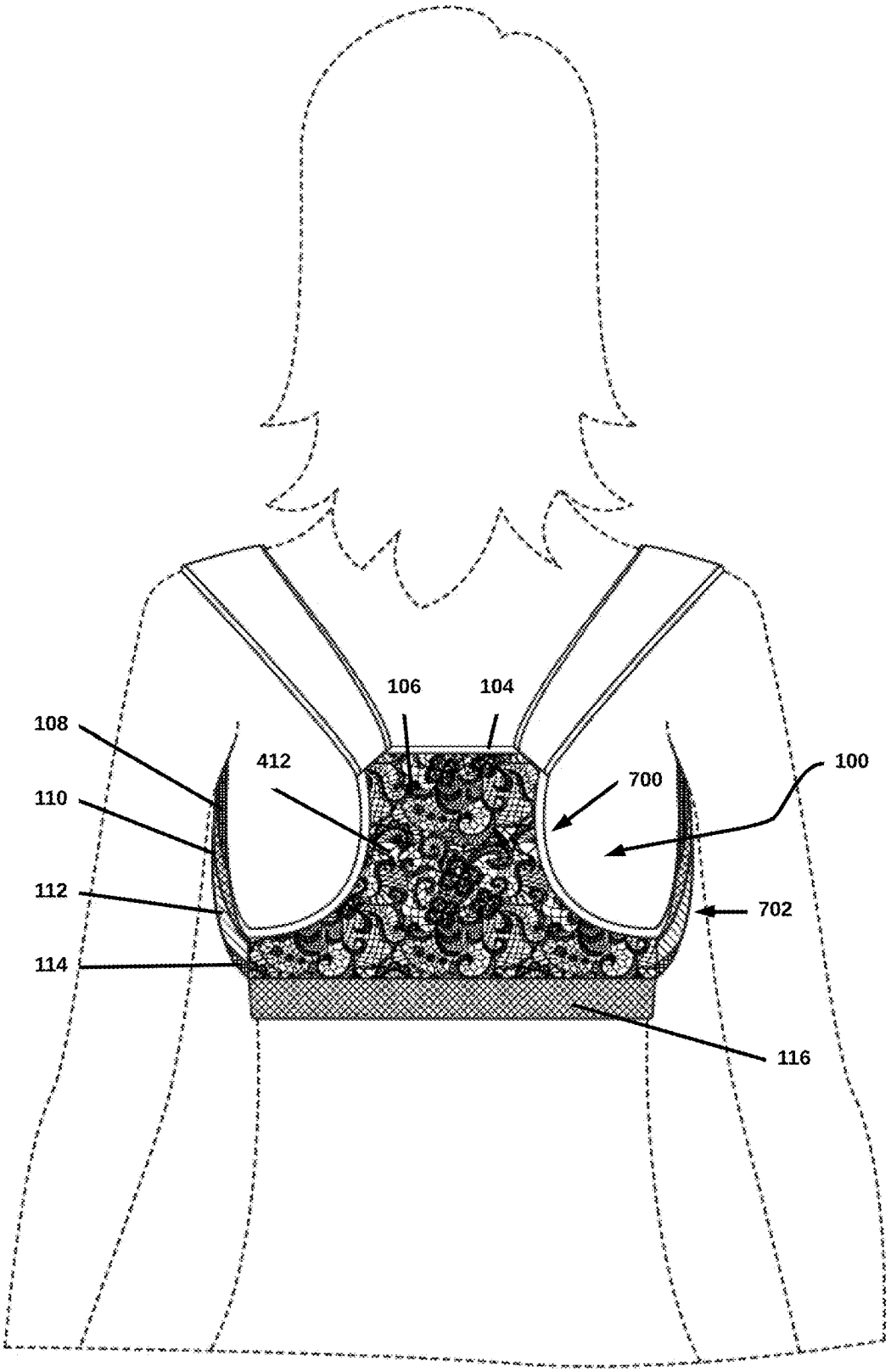
FIG. 7 illustrates a back view of an exemplary shaper garment having a racer style back, according to embodiments of the disclosure.

FIG. 7 illustrates a back view of an exemplary shaper garment 100. In various embodiments, the back 412 of the shaper garment may include a racer back design 700. A side portion 702 of the shaper garment containing side portions of the breasts that extend laterally out from the wearer's body may also be visible from the back. The side portion 702 may include three compression zones included in the cup portion 108, 110, and 112 and a fourth compression zone 114 included in the wing at the side of the garment. The back 412 of the shaper garment 100 may comprise a breathable mesh material 104 including an outer layer having an artistic lace pattern 106. As shown in FIG. 7, the bottom band 116 of the shaper garment 100 may extend to the back of the wearer and can be worn tight against the wearer's back.

Figure 9:
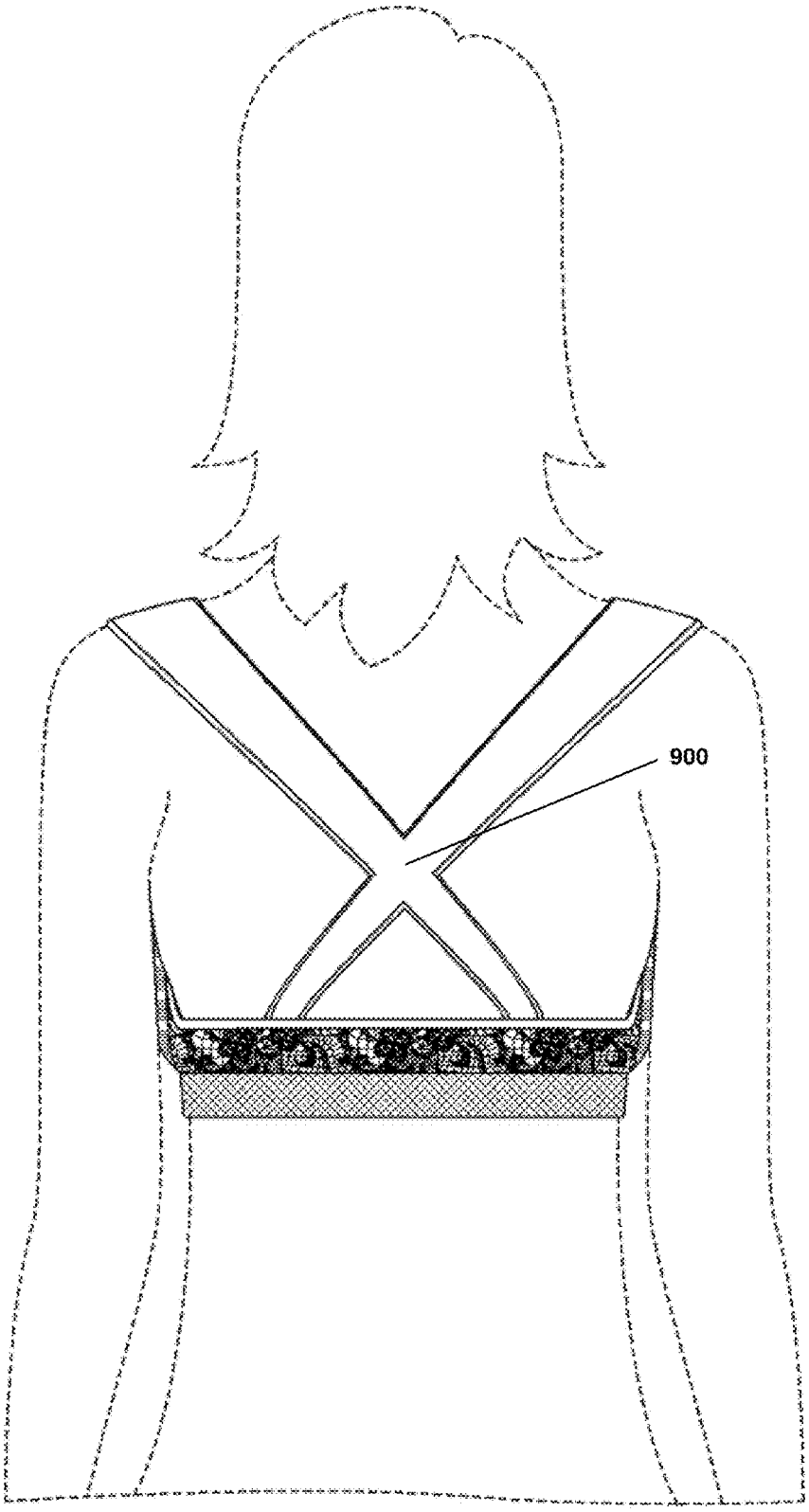
FIG. 9 illustrates a back view of an exemplary shaper garment having a cross style back, according to embodiments of the disclosure.

FIGS. 8-9 illustrate a second exemplary shaper garment design 800 including a flat V neckline 802 and a cross back 900. The shaper garment may include additional configurations and styles. For example, the shaper garment may include a strapless embodiment that does not include shoulder straps. The shaper garment may also include a back closure embodiment that has a clip at the back to the shaper garment that joins two halves of the garment to together similar to a traditional bra with a back closure mechanism. The clip of the back closure embodiment may secure the shaper garment tightly around the chest of the wearer to enable the compression zones to support, contour, and/or compress portions of the body of the wearer as described above.

An exemplary strapless embodiment may use the 3D knit structure and compression zones as described above to lift, support, and/or contour the breasts and other portions of the body of the wearer. The 3D knit structure gives the strapless embodiment of the garment a flexible fit that acts as a second layer of skin and conforms to any body shape. The fit provided by the 3D knit structure also prevents the strapless embodiment of the garment from falling off the body like traditional strapless bras. The cup portions of the strapless embodiment include an encapsulated pocket for each breast of the wearer. The encapsulated pockets are integrated into the cup portions and support each breast individually. By including cup portions that can lift, support, and/or shape the breasts, the bottom band of the strapless embodiment may be lower weight and more comfortable to wear relative to traditional strapless bras. For example, the combination of vertical and horizontal pressure provided by the encapsulated pocket may support the breasts contained within the strapless embodiment of the shaper garment. The support provided by the encapsulated pocket is more comfortable than the squeezing effect produced by traditional sports bras that apply only horizontal pressure to the breasts. Unlike traditional wire strapless bras that are require extreme tension around the circumference of the body, the encapsulated pocket, compression zones, and 3D knit structure of the strapless embodiments of the upper body shaper garment allow the wearer to breathe and not feel confined.

FIGS. 10A-B illustrate a 3D knit structure including one or more transition areas 122, 1010, 1012, 1014 between one or more areas and or compression zones of the shaper garment. As shown in FIG. 10A, a transition area 122 1010, 1012, 1014 can be positioned at the intersection between one or more areas or compression zones having different stitch densities. In various embodiments, a first transition area 122 may form the boundary and/or transition between the support area and the shaping area. A second transition area 1010 may form the boundary between the tightest compression zone and the high compression zone. A third transition area 1012 may be located between the high compression zone and the low compression zone and a fourth transition area may be located between the low compression zone and the medium compression zone.

As described above, the compression zones may be incorporated into the shaper garment by knitting stitches 1002 into an area of the garment. The stitches 1002 may be knitted in one layer with each stitch on the same horizontal plane. The stitches 1002 can be knitted as a 3D knit structure 1000 including a network of stitches incorporating two or more layers of stitches with one or more layers of stitches knitted on top of a base layer to increase the stitch density of a particular area of the shaper garment. The stitch density (e.g., number of stitches 1002 per unit of area) may determine the type of compression zone created in a particular area of the garment and the properties (e.g., compression strength, flexibility, breathability, and the like) of the particular area. For example, a tightest compression zone may have a stitch density of A and a high compression zone may have a stitch density of B, wherein A is greater than B (e.g., A may be 1.5 times, twice as large, and the like relative to B). In various embodiments, the stitch density may correspond to the loop length of the knitted material as described above.

To enhance the comfort and fit of the shaper garment and/or make the forms created by the contouring functionality of the shaper garment appear smoother and more natural, the 3D knit structure 1000 may include a stitch gradient knitted into the transition areas 122. The stitch gradient may gradually transition the 3D knit structure 1000 from the stitch density of one compression zone to the stitch density of a second compression zone. In various embodiments, the stitch gradient may include one or more intermediate regions 1004*a-c* between the compression zones included in the 3D knit structure 1000. The intermediate regions 1004*a-c* may have a stitch density that is between the first compression zone and the second compression zone. The stitch density of the intermediate regions close to the first compression zone may be very similar to the stitch density of the first compression zone. For example, the stitch density of the portions of the intermediate region that are close to (i.e., between 1 millimeter (mm) and 500 mms away from) the first compression zone may have a stitch density that is between 10% and 30% higher or lower than the stitch density of the first compression zone. For example, if the knit weight of the first compression zone is 100 gsm, the knit weight of the portions of the intermediate region that are close to the first compression zone may be between 70 gsm and 130 gsm. The stitch density of the portions of the intermediate regions that are close to (i.e., between 1 mm and 500 mm away from) the second compression zone may have a stitch density that is between 10% and 30% higher or lower than the stitch density of the second compression zone. For example, if the knit weight of the second compression zone is 200 gsm, the knit weight of the of the portions of the intermediate region that are close to the second compression zone may be between 140 gsm and 260 gsm. The stitch density may be gradually increased and/or decreased within a stitch gradient to transition from one area and/or compression zone to a second area and/or compression zone within the 3D knit structure 1000.

In the exemplary 3D knit structure 1000 shown in FIG. 10B, the stitch gradient includes three intermediate regions 1004*a-c* between a tightest compression zone 108 and a high compression zone 110. The tightest compression zone 108 may have a stitch density of 80 stitches per inch of material area with the four rows of twenty stitches each shown as the tightest compression zone 108 in FIG. 10B having a surface area of one inch. The first intermediate region 1004*a* may have ten fewer stitches knitted into the same 4×20 one inch area, therefore the stitch density of the first intermediate region is 70 stitches per inch of material. The second intermediate region 1004*b* may have ten fewer stitches relative to the first intermediate region 1004*a* knitted into the same 4×20 one inch area, therefore the stitch density of the second intermediate region 1004*b* is 60 stitches per inch of material area. The third intermediate region 1004*c* may have ten fewer stitches relative to the second intermediate region 1004*b* knitted into the same 4×20 one inch area, therefore the stitch density of the third intermediation region 1004*c* is 50 stitches per inch of material area. As shown in FIG. 10B, the high compression zone 110 has a stitch density of 40 stitches per inch of material area, therefore removing ten more stitches from the third intermediate region 1004*c* from the same 4×20 one inch area will provide the same stitch density as the high compression zone 110. By gradually removing 10 stitches per 4×20 one inch area across three transition areas 1004*a-c*, the stitch gradient gradually transitions the 3D knit structure 1000 from the stitch density of the tightest compression zone 108 (e.g., 80 stitches per one inch area) to the stitch density of the high compression zone 110. In various embodiments, stitch gradients may be used to transition the 3D knit structure 1000 between larger differences in stitch density (e.g., from 1000 stitches per unit of area to 10 stitches per unit of area) and or within smaller areas (e.g., a one millimeter area, a one centimeter area, a ten centimeter area, and the like).

In various embodiments, a first transition area located between the support area and the shaping area may have a first stitch gradient that gradually increases the stitch density of the material from a first stitch density of the support area to a second stitch density of the shaping. A second transition area can be located between a tightest compression zone and a high compression zone. The second transition area may include a second stitch gradient that gradually decreases the stitch density from a third stitch density of the tightest compression zone to a fourth stitch density of the high compression zone. A third transition area may be located between the high compression zone and a low compression zone. The third transition area may include a third stitch gradient that gradually decreases the stitch density from the fourth stitch density of the high compression zone to the fifth stitch density of the low compression zone. A fourth transition area may be located between the low compression zone and the medium compression zone. The fourth transition area my include a fourth stitch gradient that gradually increases the stitch density from the fifth stitch density of the low compression zone to the sixth stitch density of the medium compression zone.

The gradual shift in stitch density provided by the stitch gradient may enhance the comfort and/or fit of the shaper garment by making the transitions between compression zones included in the 3D knit structure 1000 feel smooth and unnoticeable. The stitch gradient may also reduce the areas of the garment that dig into, pitch, or otherwise fit uncomfortably against the body of the wearer. The stitch gradient may also make the transition zones included in the 3D knit structure 1000 more flexible and adaptable to particular shapes and surfaces of the wearer's body. The stitch gradient can improve the appearance of the forms created by the lifting and/or contouring functionality of the shaper garment. For example, the stitch gradient may smooth lines and/or curves included in the shapes created by the shaper garment. The stitch gradient may fill in gaps and/or avoid creating unevenly shaped zones in the contoured chest areas of the wearers body.

It is to be understood that the disclosed subject matter s not limited in its application to the details of construction and arrangements set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other designs, structures, methods, and systems for carrying out the several purposes of the disclosed subject matter. Therefore, the claims should be regarded as including such equivalent constructions insofar as they do not depart from the spirit and scope of the disclosed subject matter.

As used herein, the singular forms "a", "an", and "the" are intended to include the plural forms as well, unless the context clearly indicates otherwise. It will be further understood that the terms "includes" and/or "including", when used in this specification, specify the presence of stated features, steps, elements, and/or components, but do not preclude the presence or addition of one or more other features, steps, elements, components, and/or groups thereof.

As used herein, the terms "and/or" acid "at least one of include any and all combinations of one or more of the associated listed items.

As used herein, the terms "garment¯ and "shaper garment" refer to the upper body shaper garment embodiments shown in FIGS. 1-9.

Certain details are set forth in the foregoing description and in FIGS. 1-10B to provide a thorough understanding of various embodiments of the present invention. Other details describing well-known garment structures and human anatomy, however, are not set forth below to avoid unnecessarily obscuring the description of the various embodiments of the present invention.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

The invention claimed is:

1. An upper body shaper garment comprising:

two cup portions with one cup portion for covering each breast of a wearer;

a bottom band directly below the two cup portions and configured to extend across a chest area of the wearer beneath the breasts; and a back portion, configured in a racer back format, connecting to each cup portion of the two cup portions and the bottom band via a set of wings, wherein each wing, of the set of wings, is configured to be located on each side of the chest area of the wearer, the set of wings extending along the upper body shaper garment sides between a peripheral edge of each cup portion and the back portion, wherein each cup portion includes:

a support area configured to fit tightly over each breast and configured to capture an upper middle portion of each breast, the support area controlling movement of an upper section of each cup portion;

a shaping area directly below the support area and extending down from a lower peripheral edge of the support area to the bottom band, the shaping area including one or more compression zones knitted into each cup portion, the one or more compression zones compressing a bottom section of each cup portion to lift the support area above from the bottom band and push the support area adaptively out and away from a body of the wearer; and a first transition area at an intersection of the shaping area and the support area;

a second transition area between a tightest compression zone and a high compression zone, a third transition area between the high compression zone and a low compression zone, and a fourth transition area between the low compression zone and a medium compression zone;

wherein the second transition area comprises a second stitch gradient that gradually decreases a stitch density specifying a number of stitches knitted into an area of material from a third stitch density of the tightest compression zone to a fourth stitch density of the high compression zone;

wherein the third transition area comprises a third stitch gradient that gradually decreases the stitch density from the fourth stitch density of the high compression zone to a fifth stitch density of the low compression zone;

wherein the fourth transition area compresses a fourth stitch gradient that gradually increases the stitch density from the fifth stitch density of the low compression zone to a sixth stitch density of the medium compression zone.

2. The upper body shaper garment of claim 1, comprising a triangular anchor knitted into a center of the upper body shaper garment between the two cup portions and above the bottom band.

3. The upper body shaper garment of claim 2, wherein the triangular anchor compresses a lower portion of the support area at an inside peripheral edge of each cup portion configured to be tightly against the body of the wearer, the triangular anchor configured to pull an inner side of each breast inside the support area and pushing the support area away from a midpoint of the chest area toward the set of wings of the upper body shaper garment, the triangular anchor configured to lift the inner side of each breast above and away from the bottom band.

4. The upper body shaper garment of claim 1, further comprising a 3D network of stitches at the first transition area at an intersection of the shaping area and the support area, wherein the 3D network of stitches are arranged in an x, y, and z direction away from the wearer to form auxetic properties and configured to adapt to the body of the wearer.

5. The upper body shaper garment of claim 4, wherein each compression zone has a unique stitch density defining a number of stitches per area of material.

6. The upper body shaper garment of claim 1, wherein the shaping area extends from a side peripheral edge of each cup portion relative to an upper flank of the wearer to a midpoint of the chest area below the breasts and above the bottom band.

7. The upper body shaper garment of claim 6, wherein the shaping area is curved to follow a rounded portion adaptively along a bottom surface of each breast.

8. The upper body shaper garment of claim 1, wherein the set of wings include a medium compression zone extending from a bottom peripheral edge of each cup portion adaptively to a midpoint on a flank of the wearer midway between the bottom peripheral edge of each cup portion and the back portion.

9. The upper body shaper garment of claim 8, wherein the medium compression zone is configured to push a side portion of each breast away from an upper flank of the wearer toward a midpoint of the chest area.

10. The upper body shaper garment of claim 8, wherein the back portion includes breathable mesh material.

11. The upper body shaper garment of claim 1, wherein the first transition area has a first stitch gradient that gradually increases a stitch density specifying a number of stitches kitted into an area of material from a first stitch density of the support area to a second stitch density of the shaping area.

12. The upper body shaper garment of claim 1, wherein the shaping area generates a compression force lifting a lower portion of the support area away from the bottom band to contour the breasts into one or more shapes.

13. The upper body shaper garment of claim 12, wherein the support area includes an auxetic material that becomes thicker as the support area is lifted by the compression force generated by the shaping area.

14. The upper body shaper garment of claim 12, wherein the one or more shapes are from a group including options comprising a round form; a teardrop form; and a bell form.

15. The upper body shaper garment of claim 1, wherein the upper body shaper garment is knitted as one layer of continuous material without any seams, glues, or polymer adhesives.

16. The upper body shaper garment of claim 1, is comprised of one layer of continuous material including a 3D knit structure that replaces uncomfortable metal or plastic wires used in traditional manufacturing.

17. A cup portion of an upper body shaper garment comprising:

a support area configured to fit tightly over each breast and configured to capture an upper middle portion of the breasts, the support area controlling movement of an upper section of the cup portion;

a shaping area directly below the support area and extending down from a lower peripheral edge of the support area to a bottom band, the shaping area including one or more compression zones knitted into the cup portion, the one or more compression zones compressing a bottom section of the cup portion to lift the support area above from the bottom band and push the support area adaptively out and away from a body of a wearer; and a first transition area at an intersection of the shaping area and the support area;

a second transition area between a tightest compression zone and a high compression zone, a third transition area between the high compression zone and a low compression zone, and a fourth transition area between the low compression zone and a medium compression zone;

wherein the second transition area comprises a second stitch gradient that gradually decreases a stitch density specifying a number of stitches knitted into an area of material from a third stitch density of the tightest compression zone to a fourth stitch density of the high compression zone;

wherein the third transition area comprises a third stitch gradient that gradually decreases the stitch density from the fourth stitch density of the high compression zone to a fifth stitch density of the low compression zone;

wherein the fourth transition area compresses a fourth stitch gradient that gradually increases the stitch density from the fifth stitch density of the low compression zone to a sixth stitch density of the medium compression zone.

* * * * *